US007468588B2

(12) United States Patent
Yoo et al.

(10) Patent No.: US 7,468,588 B2
(45) Date of Patent: Dec. 23, 2008

(54) APPARATUS AND METHOD FOR CONTROLLING OPERATION OF RECIPROCATING COMPRESSOR

(75) Inventors: Jae-Yoo Yoo, Gyeonggi-do (KR); Chel-Woong Lee, Seoul (KR); Ji-Won Sung, Seoul (KR)

(73) Assignee: LG Electronics Inc., Seoul (KR)

( * ) Notice: Subject to any disclaimer, the term of this patent is extended or adjusted under 35 U.S.C. 154(b) by 812 days.

(21) Appl. No.: 10/989,387

(22) Filed: Nov. 17, 2004

(65) Prior Publication Data

US 2005/0111987 A1 May 26, 2005

(30) Foreign Application Priority Data

Nov. 26, 2003 (KR) ..... 10-2003-0084638
Nov. 26, 2003 (KR) ..... 10-2003-0084641

(51) Int. Cl.
*H02P 1/00* (2006.01)
*H02P 5/34* (2006.01)

(52) U.S. Cl. ..... 318/135; 318/114; 318/128; 318/632; 318/801; 417/44.11; 417/417

(58) Field of Classification Search ..... 318/114, 318/135, 128; 417/44.11, 417; 62/228.4
See application file for complete search history.

(56) References Cited

U.S. PATENT DOCUMENTS 6,220,045 B1 * 4/2001 Kim ..... 62/228.4
6,530,756 B2 * 3/2003 Morita et al. ..... 417/417
6,685,438 B2 * 2/2004 Yoo et al. ..... 417/44.11
6,753,665 B2 * 6/2004 Ueda et al. ..... 318/135
6,851,934 B2 * 2/2005 Yoo et al. ..... 417/44.11
6,977,474 B2 * 12/2005 Ueda et al. ..... 318/128
2003/0026702 A1 * 2/2003 Yoo et al. ..... 417/44.11
2003/0026703 A1 * 2/2003 Yoo et al. ..... 417/44.11
2003/0164691 A1 * 9/2003 Ueda et al. ..... 318/135
2003/0180151 A1 * 9/2003 Jeun ..... 417/44.11
2004/0169480 A1 * 9/2004 Ueda et al. ..... 318/114
2005/0111987 A1 * 5/2005 Yoo et al. ..... 417/44.11
2005/0158178 A1 * 7/2005 Yoo et al. ..... 417/45
2006/0056979 A1 * 3/2006 Yoo et al. ..... 417/44.11
2006/0056980 A1 * 3/2006 Yoo et al. ..... 417/44.11

FOREIGN PATENT DOCUMENTS

CN 1400388 A 3/2003
CN 1400389 A 3/2003
DE 10226491 A1 2/2003
JP 11141464 A 5/1999

* cited by examiner

*Primary Examiner*—Paul Ip
(74) *Attorney, Agent, or Firm*—Birch, Stewart, Kolasch & Birch, LLP

(57) ABSTRACT

The present invention relates to an apparatus and method for controlling operation of a reciprocating compressor. The operating efficiency of the compressor can be improved by performing the steps of: detecting a current and a stroke applied a compressor; a calculating a mechanical resonance frequency by using the detected current and stroke; and determining an operating frequency command value by adding or subtracting the present operating frequency so as to be within a predetermined range of the calculated mechanical resonance frequency and then driving the compressor by the operating frequency command value.

23 Claims, 11 Drawing Sheets

APPARATUS AND METHOD FOR CONTROLLING OPERATION OF RECIPROCATING COMPRESSOR

BACKGROUND OF THE INVENTION

1. Field of the Invention

The present invention relates to an apparatus and method for controlling operation of a reciprocating compressor, and in particular to an apparatus and a method for controlling operation of a reciprocating compressor which are capable of improving an operational efficiency of a compressor by making the operation frequency of the compressor according to the variation of a load consistent with a mechanical resonant frequency.

2. Description of the Background Art

These days various types of compressors are used, among them a reciprocating compressor is generally used. The reciprocating compressor sucks, compresses and discharges a refrigerating gas by a piston moving up and down inside a cylinder.

The reciprocating compressor is divided into a recipro type and a linear type according to the method of driving a piston.

The recipro type is such a type that changes the rotary movement of a motor into a linear movement and necessarily requires mechanical conversion devices such as a screw, a chain, a gear system, a timing belt, etc. for transforming a rotary movement into a linear movement. The use of the mechanical conversion device causes a large energy transformation loss and makes the structure of a compressor complex. Thus, in recent times, a reciprocating compressor employing a linear type in which a motor itself performs a linear movement is used.

In the reciprocating compressor employing the linear type, no mechanical conversion device is required because the motor itself directly generates a linear type driving force, the structure is not complex, a loss from an energy transformation can be reduced, and noise can be drastically reduced since there is joint regions generating friction or abrasion.

When the reciprocating compressor is used for a refrigerator or an air conditioner, a compression ratio can be varied by varying a stroke voltage applied to the reciprocating compressor, accordingly it is advantageous to a variable refrigerating capacity control.

FIG. 1 is a block diagram illustrating a construction of an apparatus for controlling operation of a reciprocating compressor in accordance with the prior art.

As depicted in FIG. 1, the prior art apparatus for controlling operation of a reciprocating compressor includes a reciprocating compressor 3 adjusting a refrigerating capacity by varying a stroke (a distance between a top dead center and a bottom dead center of the piston) by an up and down movement of a piston by a stroke voltage, a voltage detecting unit 5 detecting a voltage generated in the reciprocating compressor 3, a current detecting unit 6 detecting a current applied to the reciprocating compressor 3, a stroke calculating unit 4 estimating a stroke by using the detected current and voltage and a motor parameter, a comparator 10 comparing the calculated stroke with a certain stroke command value and outputting a comparison value according to the comparison result and a controller 2 controlling a stroke by varying the voltage applied to the motor based on the comparison value.

The control operation of the reciprocating compressor in accordance with the prior art will be described.

In the reciprocating compressor, when a stroke voltage is outputted by being inputted a certain stroke command value from a user, a stroke is varied by an up and down movement of a piston of a cylinder, a refrigerating gas inside the cylinder is transmitted to a condenser through a discharge valve, accordingly a refrigerating capacity can be adjusted. At this time, the voltage detecting unit 5 and the current detecting unit 6 detect a voltage and a current generated in the reciprocating compressor 3 and outputs them to the stroke calculating unit 4. The stroke calculating unit 4 utilizes the voltage, current and motor parameter to below equations and calculates a velocity of a piston (equation 1) and a calculated stroke (equation 2) by below equations.

$$\text{Velocity} = V_M - Ri - L\frac{di}{dt} \quad \text{(Equation 1)}$$

$$\text{Stroke} = \frac{1}{\alpha}\int(\text{Velocity})\,dt \quad \text{(Equation 2)}$$

Here, $\alpha$ is a motor constant for calculating a stroke, i.e., a constant for converting an electric force into a mechanical force, R is a loss value due to resistance such as a copper loss or an iron loss, L is an inductance, and $V_M$ is a voltage between both ends of a motor.

The comparator 1 compares the stroke command value with the calculated stroke and applies a comparison signal to the controller 2, and the controller 2 varies the voltage applied to the motor of the reciprocating compressor 3 to control a stroke.

FIG. 2 is a flow chart illustrating a method for controlling operation of a reciprocating compressor in accordance with the prior art.

As depicted in FIG. 2, in the method for controlling operation of a reciprocating compressor, a voltage and a current are detected from the reciprocating compressor 3, and the calculation of a current calculated stroke is performed in the stroke calculating unit 4 (St1).

Afterwards, when the present stroke value calculated is smaller than the stroke command value, the controller 2 increases a stroke voltage (St2, St3), when the present stroke value calculated is larger than the stroke command value, the controller 2 decreases a stroke voltage (St2, St4).

However, even through a change of a mechanical resonant frequency occurs according to the variation of a load (for example, the outdoor temperature or a condenser temperature, etc.), the above-described prior art reciprocating compressor always controls a stroke at a constant operating frequency to drive the compressor, thus the operating efficiency is degraded.

SUMMARY OF THE INVENTION

Therefore, an object of the present invention is to provide an apparatus and method for controlling operation of a reciprocating compressor which are capable of improving an operational efficiency of a compressor by a frequency variation control by calculating a mechanical resonance frequency according to a load variation and making the operation frequency of the compressor consistent with the mechanical resonant frequency according to the variation of a load.

To achieve the above object, there is provided an apparatus for controlling operation of a reciprocating compressor in accordance with the present invention which comprises: a mechanical resonance frequency calculating unit calculating a mechanical resonance frequency based on a current and a stroke applied to a compressor; an operating frequency command value determining unit determining an operating frequency command value within a predetermined range of the calculated mechanical resonance frequency; and a controller varying and controlling an operating frequency according to a comparison value between the determined operating frequency command value and the present operating frequency.

To achieve the above object, there is provided a method for controlling operation of a reciprocating compressor in accordance with the present invention which comprises the steps of: detecting a current and a stroke applied to a compressor; calculating a mechanical resonance frequency based on the detected current and stroke; and determining an operating frequency command value by adding or subtracting the present operating frequency so as to be within a predetermined range of the calculated mechanical resonance frequency and then driving the compressor by the operating frequency command value.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Figure 1:
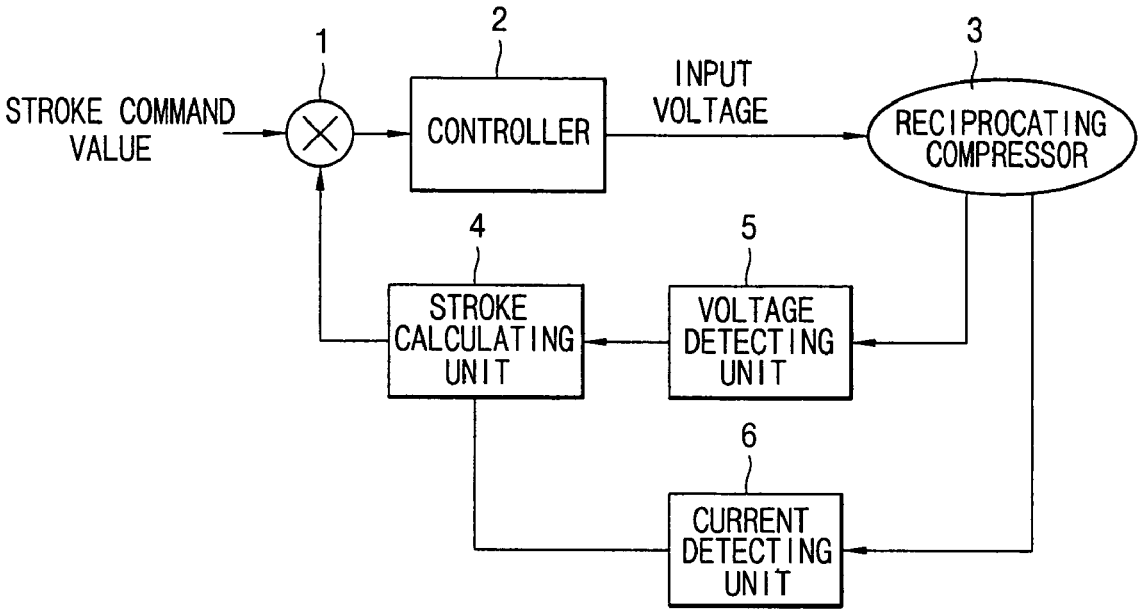
FIG. 1 RELATED ART
FIG. 1 is a block diagram illustrating a construction of an apparatus for controlling operation of a reciprocating compressor in accordance with the prior art.
Figure 2:
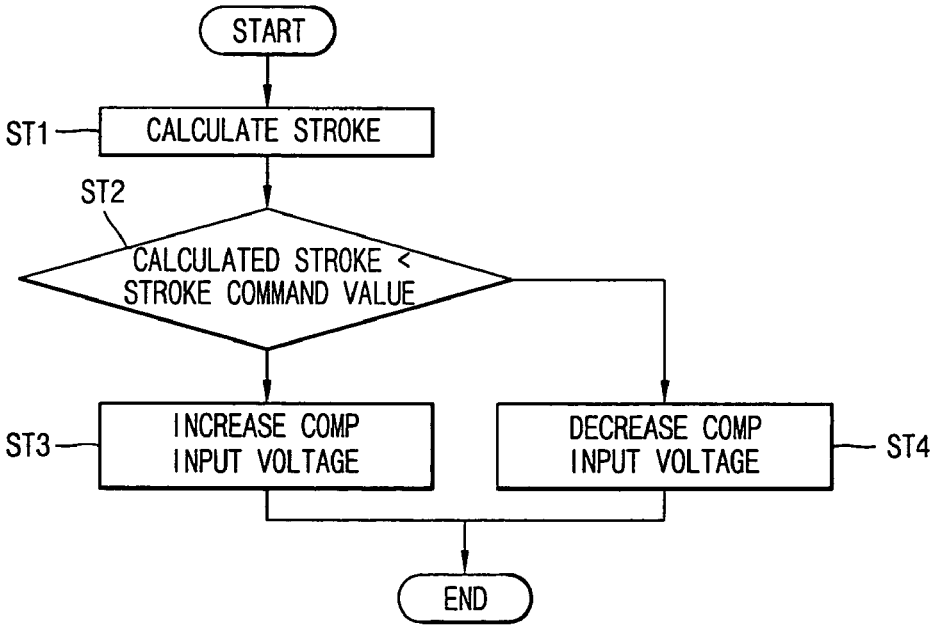
FIG. 2 RELATED ART
FIG. 2 is a flow chart illustrating a method for controlling operation of a reciprocating compressor according to a calculated stroke in accordance with the prior art.
Figure 3:
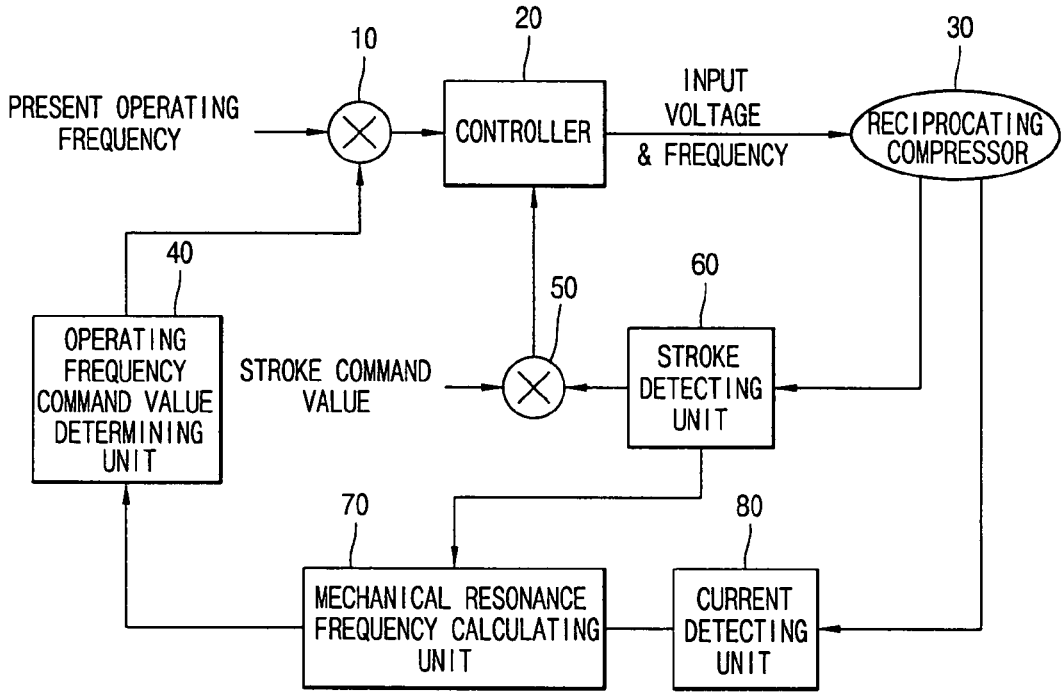
FIG. 3 is a block diagram illustrating a construction of an apparatus for controlling operation of a reciprocating compressor in accordance with the present invention.

FIG. 3 is a block diagram illustrating a construction of an apparatus for controlling operation of a reciprocating compressor in accordance with the present invention.

As shown in FIG. 3, an apparatus for controlling operation of a reciprocating compressor in accordance with the present invention comprises: a current detecting unit 80 detecting a current applied to a compressor 30; a stroke detecting unit 60 detecting a stroke of the compressor 30; a mechanical resonance frequency calculating unit 70 calculating a mechanical resonance frequency based on the current output from the current detecting unit 80 and the stroke output from the stroke detecting unit 60; an operating frequency command value determining unit 40 determining an operating frequency command value within a predetermined range ($0\pm\delta$) of a mechanical resonance frequency based on the calculated mechanical resonance frequency; a first comparator 10 comparing the operating frequency command value wand a present operating frequency and outputting a comparison value; a second comparator 50 comparing the stroke output from the stroke detecting unit 60 and a stroke command value and outputting a comparison value; and a controller 20 controlling a stroke by varying the operating frequency of the compressor according to the comparison value of the operating frequency output from the first comparator 10 and varying the voltage applied to the compressor according to the comparison value of the stroke output from the second comparator 50.

Here, the compressor 30 means a reciprocating compressor, preferably, a reciprocating compressor employing a linear type.

Further, the mechanical resonance frequency can be obtained by many methods in accordance with the following embodiment.

For example, a current according to the maximum value of a stroke in a period, a current according to the minimum value of a stroke in a period, a current value calculated by subtracting a current according to the minimum value of a stroke in a period from a current according to the maximum value of a stroke in a period, a stroke according to the maximum value of a current in a period, a stroke according to the minimum value of a current in a period, or a stroke calculated by subtracting a stroke according to the minimum value of a current in a period from a stroke according to the maximum value of a current in a period are detected, and a frequency at which the detected current or stroke becomes 0 is judged to be a mechanical resonance frequency.

Further, the predetermined range ($0\pm\delta$) of a mechanical resonance frequency is selected in proportion to a current according to the maximum value of a stroke in a period, a current according to the minimum value of a stroke in a period, a current value calculated by subtracting a current according to the minimum value of a stroke in a period from a current according to the maximum value of a stroke in a period, a stroke according to the maximum value of a current in a period, a stroke according to the minimum value of a current in a period, or a stroke calculated by subtracting a stroke according to the minimum value of a current in a period from a stroke according to the maximum value of a current in a period.

For example, the predetermined range (δ) of a mechanical resonance frequency is 0.1×the maximum value of a current in one period or 0.1×the minimum value of a stroke in one period.

The operation according to the construction of the apparatus for controlling a reciprocating compressor in accordance with the present invention will be described with reference to FIGS. 4 to 6.

Figure 4:
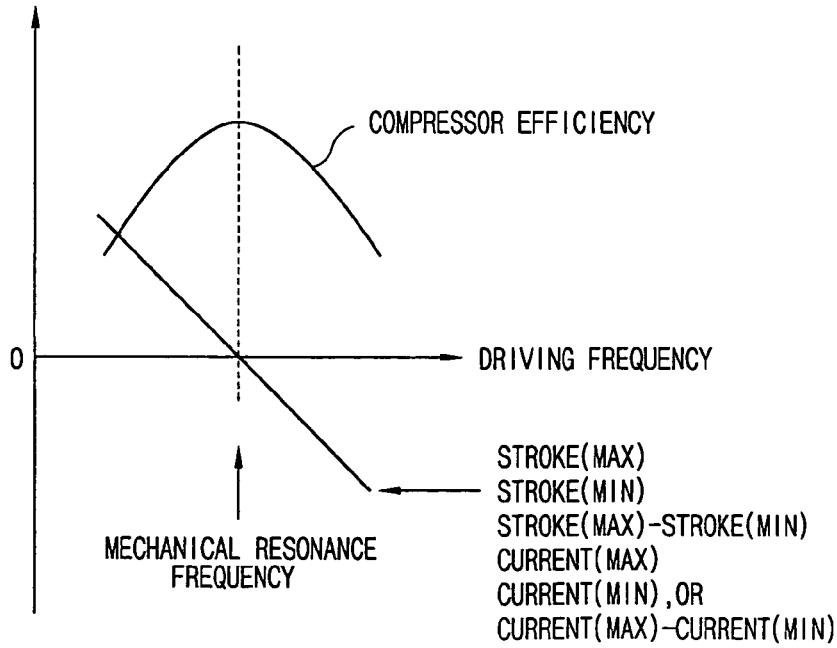
FIG. 4 is a graph illustrating a relationship between a mechanical resonance frequency and a compressor efficiency in FIG. 3 in accordance with the present invention.

FIG. 4 is a graph illustrating a relationship between a mechanical resonance frequency and a compressor efficiency in FIG. 3 in accordance with the present invention.

As shown in FIG. 4, in the present invention, the compressor has the maximum operating frequency when the compressor is operated closely at a mechanical resonance frequency.

Figure 5:
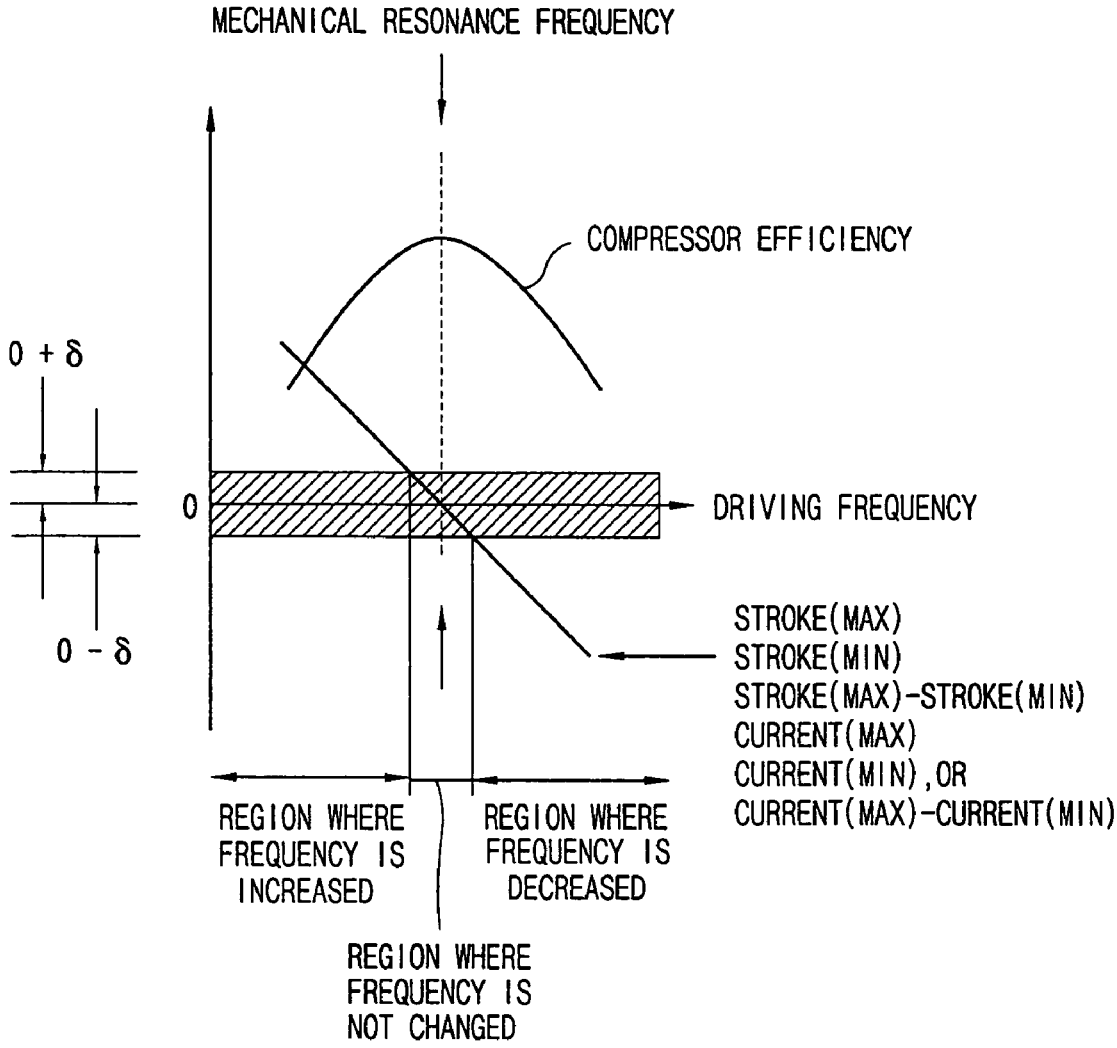
FIG. 5 is a graph illustrating the size of an operating frequency corresponding to the size of a mechanical resonance frequency in FIG. 3 in accordance with the present invention.

FIG. 5 is a graph illustrating the size of an operating frequency corresponding to the size of a mechanical resonance frequency in FIG. 3 in accordance with the present invention.

As shown in FIG. 5, an operating frequency command value is determined within a predetermined range (0±δ) of a mechanical resonance frequency in FIG. 3 in order to increase the efficiency of the compressor in the variation of a load.

Figure 6:
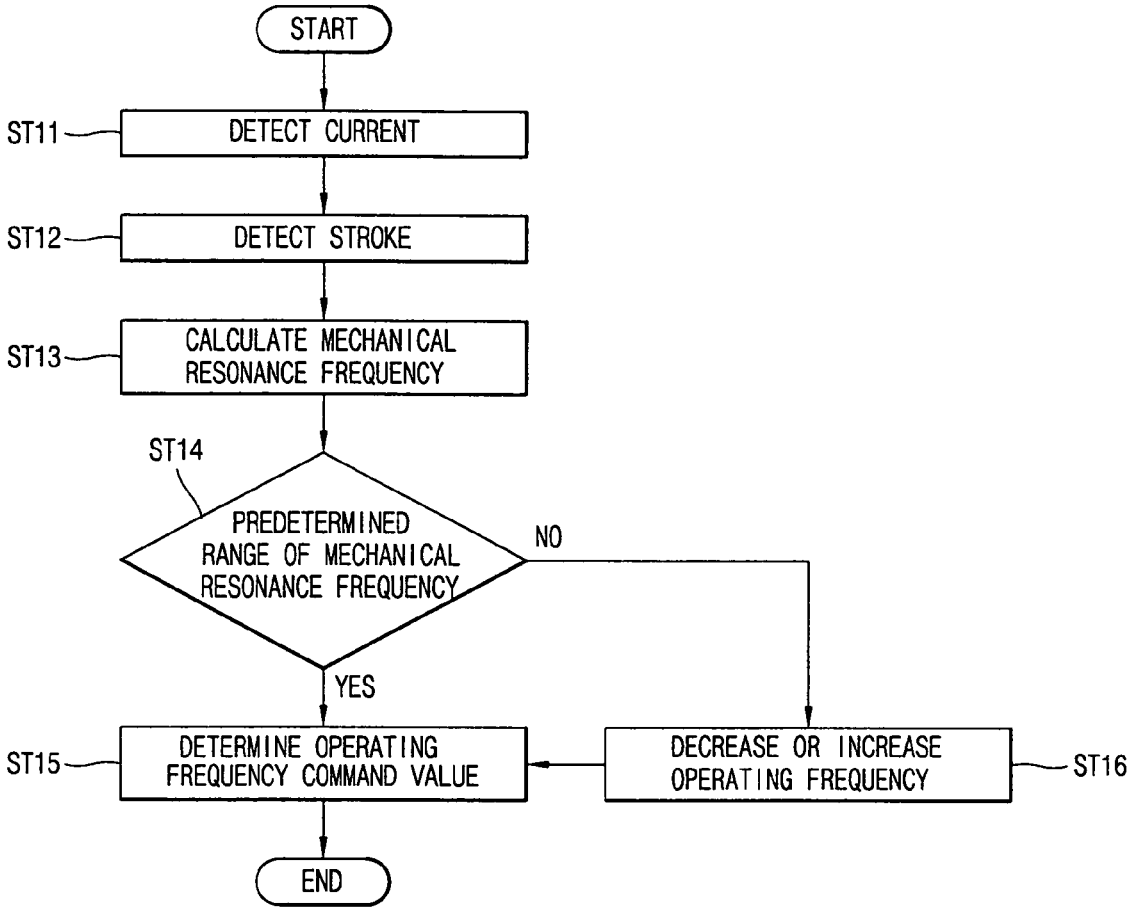
FIG. 6 is a graph illustrating a method for controlling operation of a reciprocating compressor in accordance with the present invention.

FIG. 6 is a graph illustrating a method for controlling operation of a reciprocating compressor in accordance with the present invention.

Firstly, the current detecting unit 80 detects a current applied to the compressor (St 11), and the stroke detecting unit 60 detects a stroke of the compressor 30 (St 12). The mechanical resonance frequency calculating unit 70 calculates a mechanical resonance frequency based on the current output from the current detecting unit 80 and the stroke output from the stroke detecting unit 60 (St 13). The operating frequency command value determining unit 40 determines and outputs an operating frequency command value so that the compressor 30 can be operated nearly at the mechanical resonance frequency output from the mechanical resonance frequency calculating unit 70 (St 14 to St 16).

For example, if the present operating frequency is a value within a predetermined range (0±δ) of a mechanical resonance frequency, the present operating frequency is determined as an operating frequency command value without a frequency variation (St 14 and St 15), if the present operating frequency is larger than a predetermined range (0±δ) of a mechanical resonance frequency, the present operating frequency is increased to a predetermined level and the increased operating frequency is determined as an operating frequency command value, and if the present operating frequency is smaller than the predetermined range (0±δ) of a mechanical resonance frequency, the present operating frequency is decreased to a predetermined level and the decreased operating frequency is determined as an operating frequency command value (St 14 and St 16).

Afterwards, the first comparator 10 compares the operating frequency command value and the present operating frequency and outputs the corresponding comparison value, and the second comparator 50 compares a stroke command value and a stroke output from the stroke detecting unit 60 and outputs a comparison value.

Finally, the controller 20 drives the compressor by controlling a stroke by varying an operating frequency applied to the compressor according to the comparison value of the operating frequency output from the first comparator 10 and, at the same time, varying a voltage applied to the compressor according to the output value of the second comparator 50.

FIGS. 7 to 10 are flow charts of various embodiments for determining an operating frequency command value in the method for controlling operation of a reciprocating compressor in accordance with the present invention.

Figure 7:
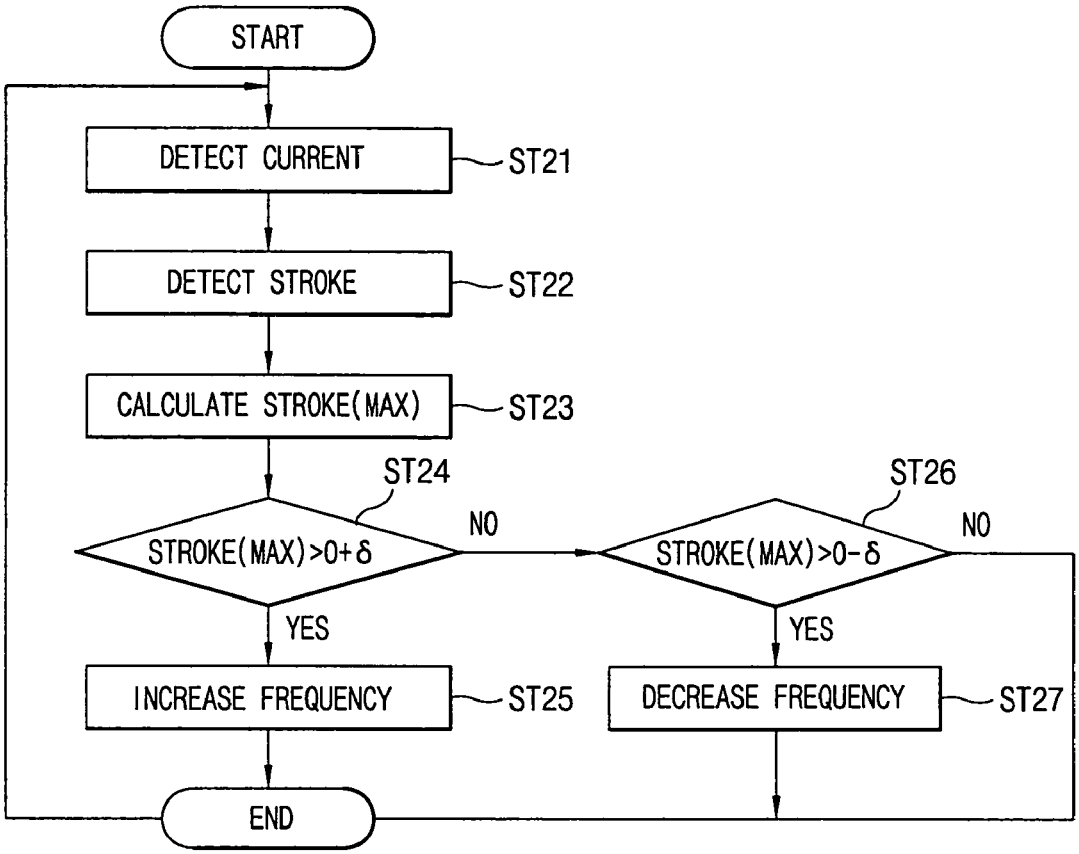
FIG. 7 is a flow chart illustrating a method for controlling operation of a reciprocating compressor by which an operating frequency command value is determined by using a current according to the maximum value of a stroke in a period.

FIG. 7 is a flow chart illustrating a method for controlling operation of a reciprocating compressor by which an operating frequency command value is determined by using a current according to the maximum value of a stroke in a period.

As shown in FIG. 7, firstly, a current and stroke of the compressor are detected (St 21 and St 22), and a current according to the maximum value of a stroke in a period is calculated based on the detected current and stroke (St 23). Thereafter, a frequency at which the detected current becomes 0 is judged to be a mechanical resonance frequency, and an operating frequency command value is determined by increasing or decreasing the operating frequency so that the compressor can be operated nearly at the mechanical resonance frequency (St 24 to St 27).

Figure 8:
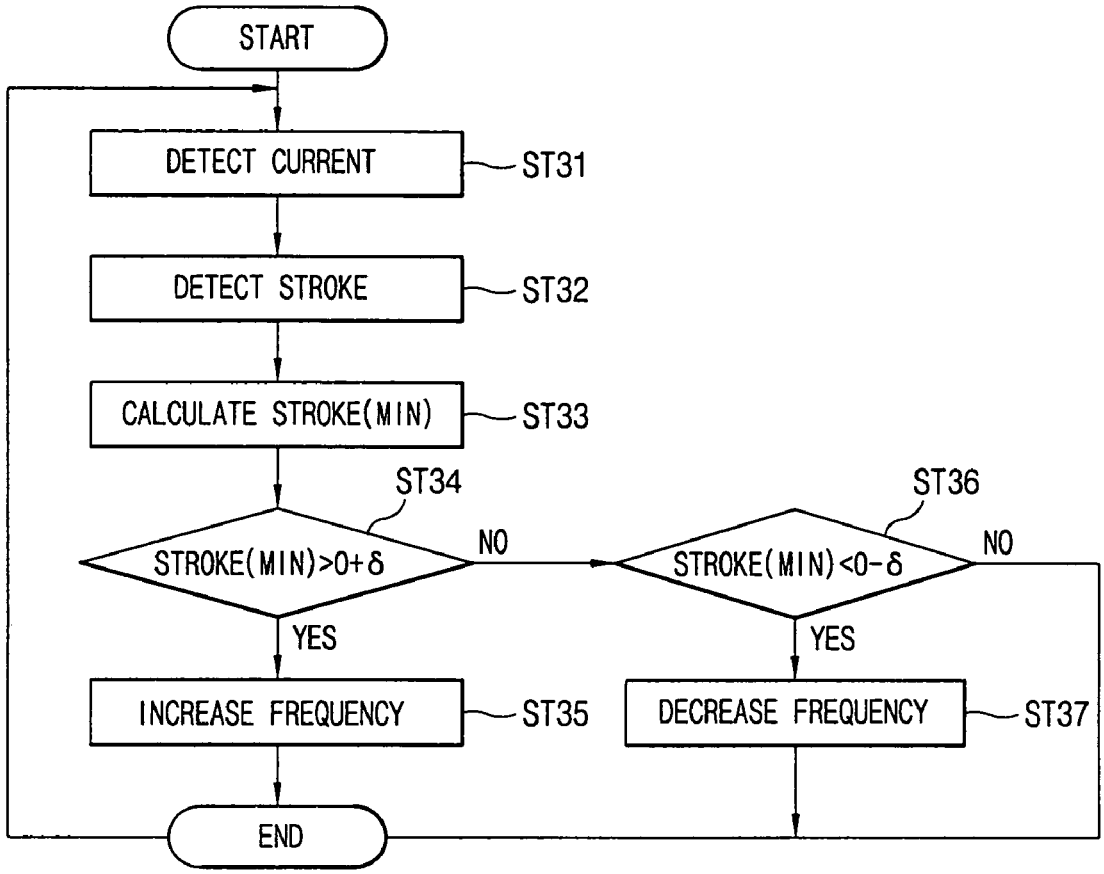
FIG. 8 is a flow chart illustrating a method for controlling operation of a reciprocating compressor by which an operating frequency command value is determined by using a current according to the minimum value of a stroke in a period.

FIG. 8 is a flow chart illustrating a method for controlling operation of a reciprocating compressor by which an operating frequency command value is determined by using a current according to the minimum value of a stroke in a period.

As shown in FIG. 8, a current and stroke of the compressor are detected (St 31 and St 32), and a current according to the minimum value of a stroke in a period is calculated based on the detected current and stroke (St 33). Thereafter, a frequency at which the detected current becomes 0 is judged to be a mechanical resonance frequency, and an operating frequency command value is determined by increasing or decreasing the operating frequency so that the compressor can be operated nearly at the mechanical resonance frequency (St 34 to St 37).

Figure 9:
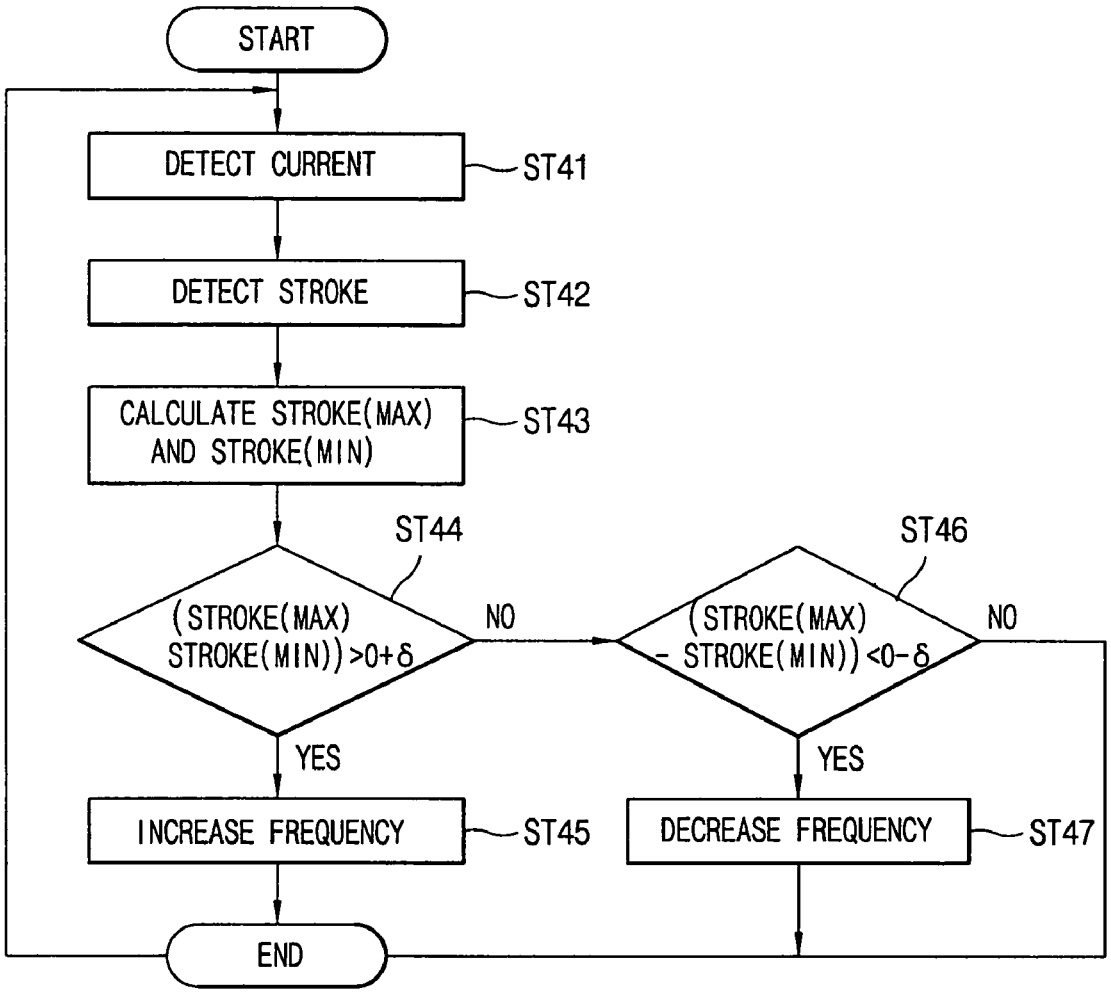
FIG. 9 is a flow chart illustrating a method for controlling operation of a reciprocating compressor by which an operating frequency command value is determined by using a current value calculated by subtracting a current according to the minimum value of a stroke in a period from a current according to the maximum value of a stroke in a period.

FIG. 9 is a flow chart illustrating a method for controlling operation of a reciprocating compressor by which an operating frequency command value is determined by using a current value calculated by subtracting a current according to the minimum value of a stroke in a period from a current according to the maximum value of a stroke in a period.

As shown in FIG. 9, a current and stroke of the compressor are detected (St 41 and St 42), and a current value is calculated by subtracting a current according to the minimum value of a stroke in a period from a current according to the maximum value of a stroke in a period (St 43). Thereafter, a frequency at which the detected current becomes 0 is judged to be a mechanical resonance frequency, and an operating frequency command value is determined by increasing or decreasing the operating frequency so that the compressor can be operated nearly at the mechanical resonance frequency (St 44 to St 47).

Figure 10:
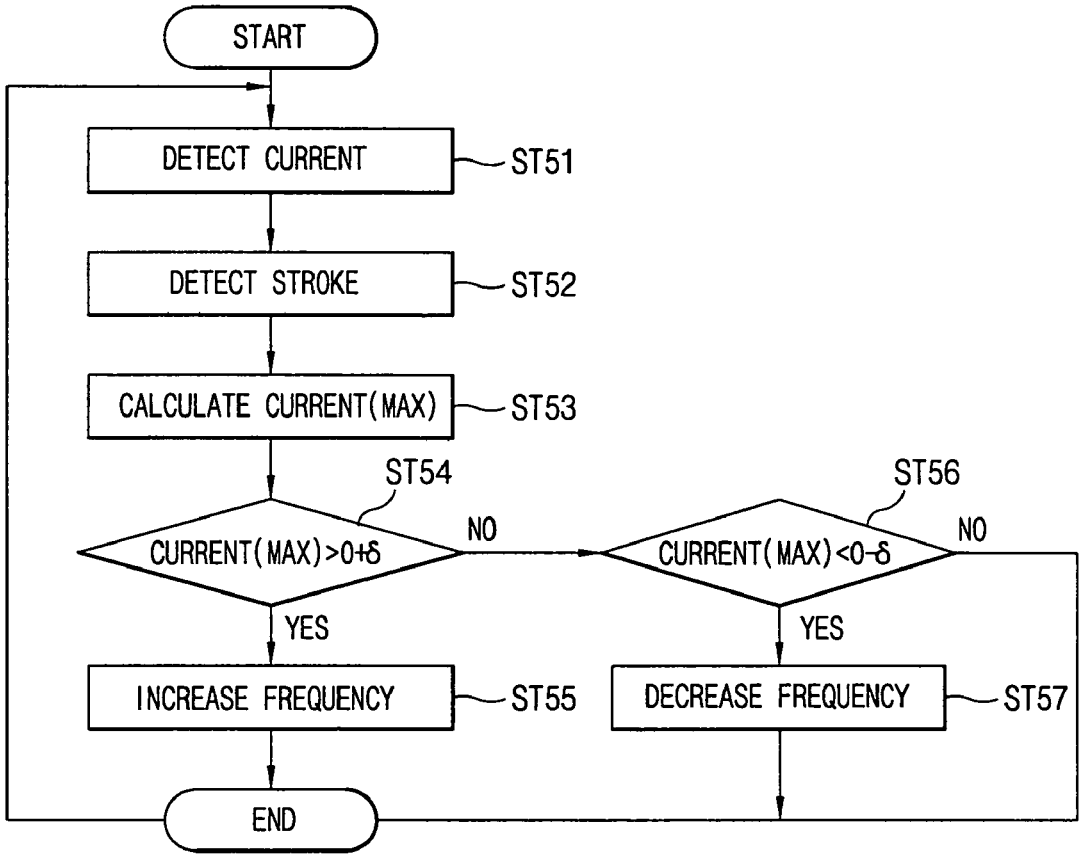
FIG. 10 is a flow chart illustrating a method for controlling operation of a reciprocating compressor by which an operating frequency command value is determined by using a stroke according to the maximum value of a current in a period.

FIG. 10 is a flow chart illustrating a method for controlling operation of a reciprocating compressor by which an operating frequency-command value is determined by using a stroke according to the maximum value of a current in a period.

As shown in FIG. 10, a current and stroke of the compressor are detected (St 51 and St 52), and a stroke according to the maximum value of a current in a period is calculated based on the detected current and stroke (St 53). Thereafter, a frequency at which the detected stroke becomes 0 is judged to be a mechanical resonance frequency, and an operating frequency command value is determined by increasing or decreasing the operating frequency so that the compressor can be operated nearly at the mechanical resonance frequency (St 54 to St 57).

Figure 11:
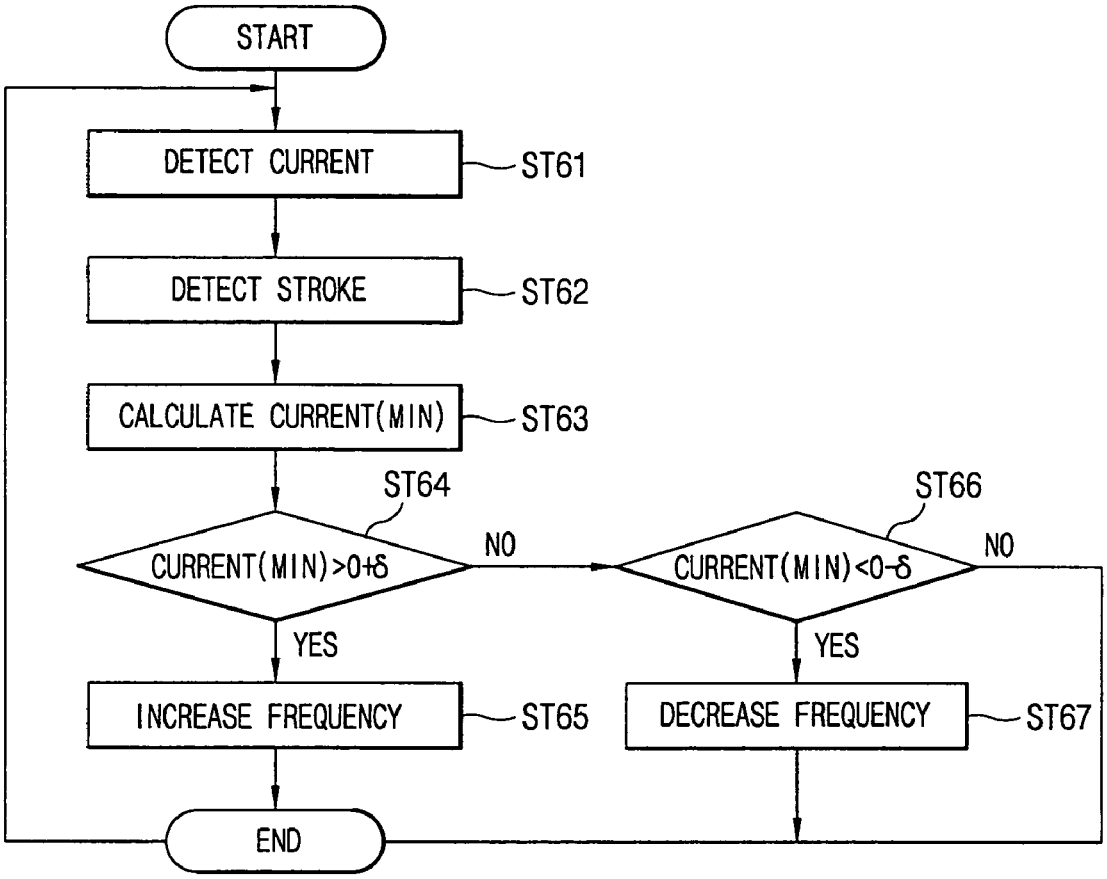
FIG. 11 is a flow chart illustrating a method for controlling operation of a reciprocating compressor by which an operating frequency command value is determined by using a stroke according to the minimum value of a current in a period.

FIG. 11 is a flow chart illustrating a method for controlling operation of a reciprocating compressor by which an operating frequency command value is determined by using a stroke according to the minimum value of a current in a period.

As shown in FIG. 11, a current and stroke of the compressor are detected (St 61 and St 62), and a stroke according to the minimum value of a current in a period is calculated based on the detected current and stroke (St 63). Thereafter, a frequency at which the detected stroke becomes 0 is judged to be a mechanical resonance frequency, and an operating frequency command value is determined by increasing or decreasing the operating frequency so that the compressor can be operated nearly at the mechanical resonance frequency (St 64 to St 67).

Figure 12:
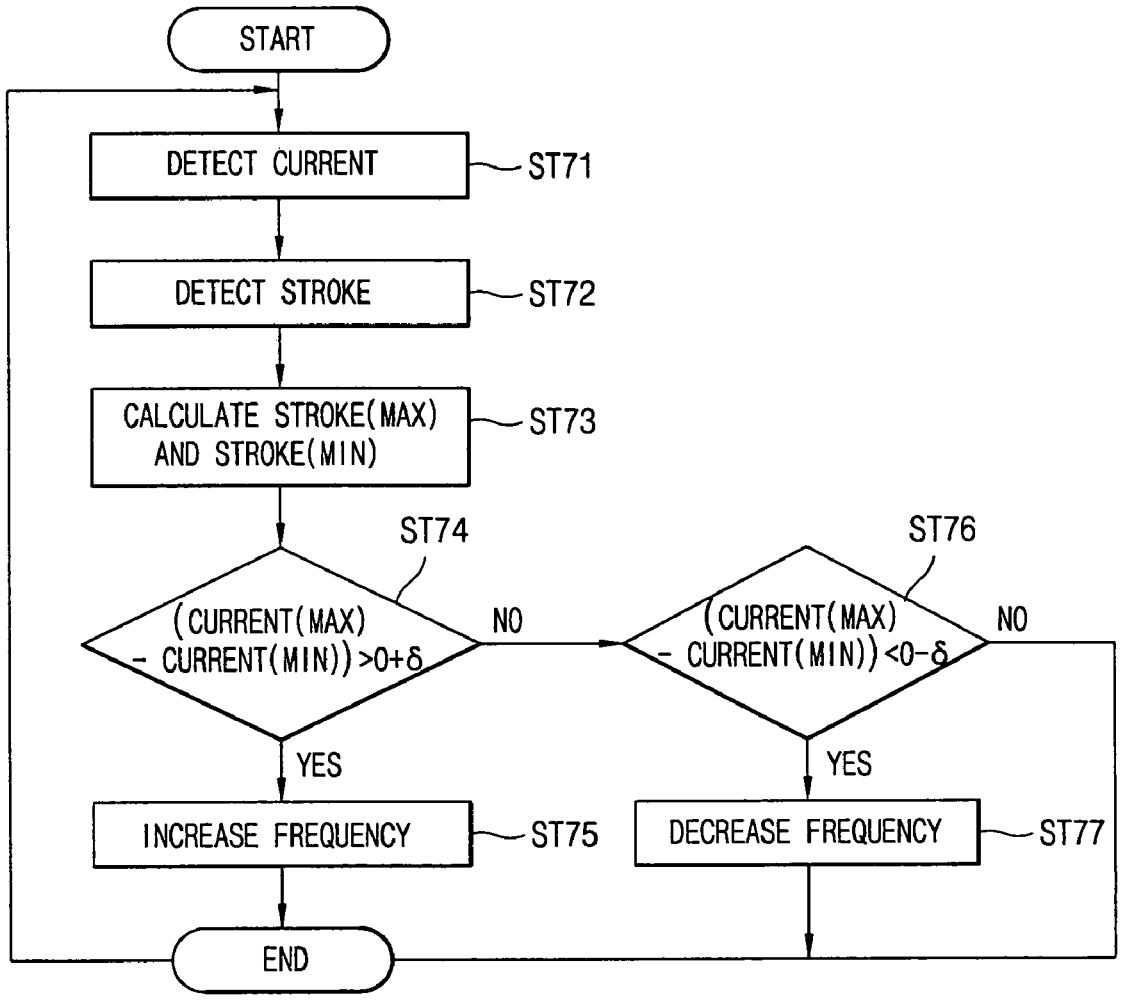
FIG. 12 is a flow chart illustrating a method for controlling operation of a reciprocating compressor by which an operating frequency command value is determined by using a stroke calculated by subtracting a stroke according to the minimum value of a current in a period from a stroke according to the maximum value of a current in a period.

FIG. 12 is a flow chart illustrating a method for controlling operation of a reciprocating compressor by which an operating frequency command value is determined by using a stroke calculated by subtracting a stroke according to the minimum value of a current in a period from a stroke according to the maximum value of a current in a period.

As shown in FIG. 12, a current and stroke of the compressor are detected (St 71 and St 72), and a stroke is calculated by subtracting a stroke according to the minimum value of a current in a period from a stroke according to the maximum value of a current in a period (St 73). Thereafter, a frequency at which the detected stroke becomes 0 is judged to be a mechanical resonance frequency, and an operating frequency command value is determined by increasing or decreasing the operating frequency so that the compressor can be operated nearly at the mechanical resonance frequency (St 74 to St 77).

Figure 13:
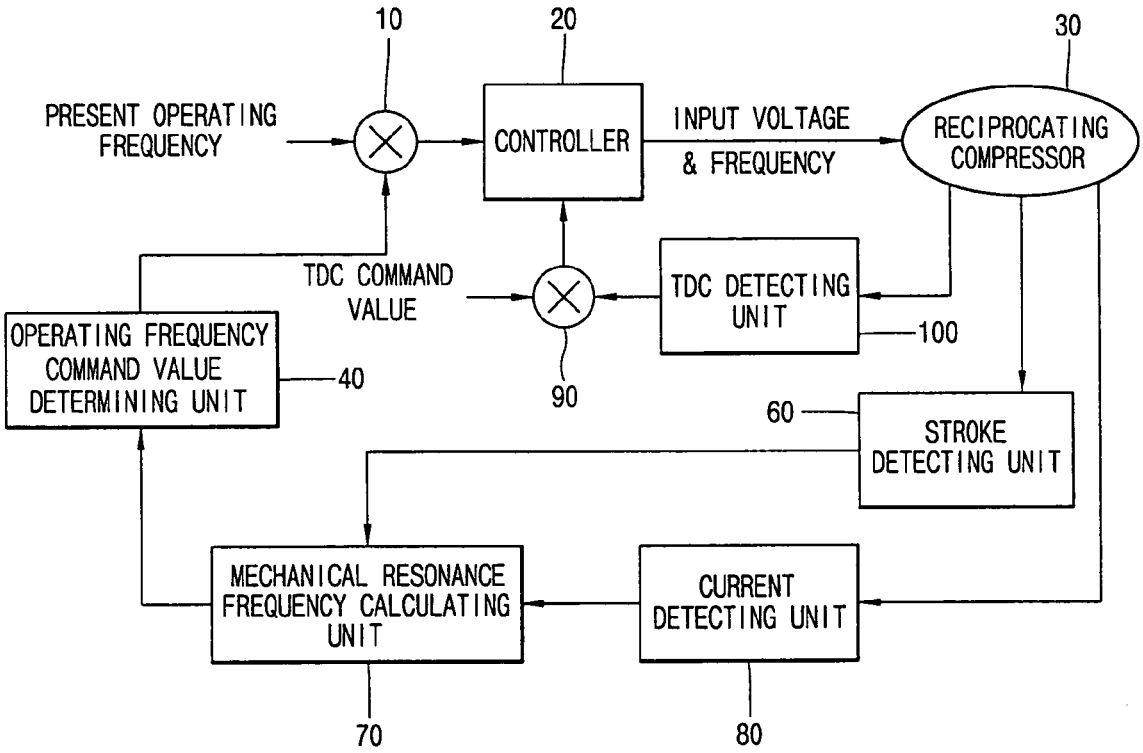
FIG. 13 is a block diagram illustrating a construction of an apparatus for controlling operation of a reciprocating compressor with a TDC detecting unit in accordance with another embodiment of the present invention.

FIG. 13 is a block diagram illustrating a construction of an apparatus for controlling operation of a reciprocating compressor with a TDC (top dead center) detecting unit in accordance with another embodiment of the present invention.

As shown in FIG. 13, the apparatus for controlling operation of a reciprocating compressor in accordance with another embodiment of the present invention comprises: a current detecting unit 80 detecting a current applied to a compressor 30; a stroke detecting unit 60 detecting a stroke of the compressor 30; a TDC detecting unit 100 detecting a position at which an upper limit of the movement of a piston inside a cylinder or the volume of the cylinder is the minimum; a mechanical resonance frequency calculating unit 70 calculating a mechanical resonance frequency based on a current output from the current detecting unit 80 and a stroke output from the stroke detecting unit 60; an operating frequency command value determining unit 40 determining an operating frequency command value within a predetermined range (0±δ) of the calculated mechanical resonance frequency; a first comparator 10 comparing the operating frequency command value and the present operating frequency and outputting a comparison value; a second comparator 90 comparing a TDC output from the TDC detecting unit 100 and a TDC command value and outputting a comparison value; and a controller 20 controlling a stroke by varying an operating frequency of a compressor according to the comparison value of the operating frequency output form the first comparator 10 and varying a voltage applied to the compressor according to a TDC comparison value output from the second comparator 90.

The operation of the apparatus for controlling operation of the reciprocating compressor in accordance with another embodiment of the present invention will be described.

Firstly, the current detecting unit 80 detects a current applied to the compressor, and the stroke detecting unit 60 detects a stroke of the compressor 30. The mechanical resonance frequency calculating unit 70 calculates a mechanical resonance frequency based on the current output from the current detecting unit 80 and the stroke output from the stroke detecting unit 60.

Afterwards, the operating frequency command value determining unit 40 determines and outputs an operating frequency command value so that the compressor 30 can be operated nearly at the mechanical resonance frequency output from the mechanical resonance frequency calculating unit 70.

The operating frequency command value determining unit 40 determines and outputs an operating frequency command value by comparing the operating frequency command value with the predetermined range (0±δ) of the mechanical resonance frequency and adding or subtracting the operating frequency based on the result of the comparison.

Afterwards, the first comparator 10 compares the operating frequency command value and the present operating frequency and outputs the corresponding comparison value, and the second comparator 90 compares a TDC command value and a TDC output from the TDC detecting unit 100 and outputs a comparison value of the TDC. Accordingly, the controller 20 controls the TDC by varying an operating frequency applied to the compressor according to the comparison value of the operating frequency output from the first comparator 10 and, at the same time, varying a voltage applied to the compressor according to the output value of the second comparator 90. Accordingly, the present invention can perform an accurate TDC feedback control according to the variation of a load, thus the operating frequency of the compressor can be increased.

As described above in detail, in the present invention, in order to make the operating frequency of the compressor according to the variation of a load consistent with a mechanical resonance frequency, a current according to the maximum value of a stroke in a period, a current according to the minimum value of a stroke in a period, a current value calculated by subtracting a current according to the minimum value of a stroke in a period from a current according to the maximum value of a stroke in a period, a stroke according to the maximum value of a current in a period, a stroke according to the minimum value of a current in a period, or a stroke calculated by subtracting a stroke according to the minimum value of a current in a period from a stroke according to the maximum value of a current in a period are detected, and an operating frequency command value is determined based on those values, whereby a more accurate stroke feedback control or a TDC feedback control is carried out to improve the operating efficiency of the compressor.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An apparatus for controlling operation of a reciprocating compressor, comprising:

a mechanical resonance frequency calculating unit calculating a mechanical resonance frequency based on a current and a stroke applied to a compressor;

an operating frequency command value determining unit determining an operating frequency command value within a predetermined range of the calculated mechanical resonance frequency; and a controller varying an operating frequency according to a comparison value between the determined operating frequency command value and the present operating frequency, and driving the compressor based on the determined operating frequency command value.

2. The apparatus of claim 1, wherein the operating frequency command value determining unit determines the present operating frequency as an operating frequency command value without a load variation when the present operating frequency is a value within a predetermined range of the mechanical resonance frequency.

3. The apparatus of claim 1, wherein the operating frequency command value determining unit increases the present operating frequency to a predetermined level when the present operating frequency is larger than a predetermined range of a mechanical resonance frequency and determines the increased operating frequency as an operating frequency command value.

4. The apparatus of claim 1, wherein the operating frequency command value determining unit decreases the present operating frequency to a predetermined level when the present operating frequency is smaller than a predetermined range of a mechanical resonance frequency and determines the decreased operating frequency as an operating frequency command value.

5. The apparatus of claim 1, wherein the predetermined range of the mechanical resonance frequency is set in proportion to one of a current according to the maximum value of a stroke in a period, a current according to the minimum value of a stroke in a period, a current value calculated by subtracting a current according to the minimum value of a stroke in a period from a current according to the maximum value of a stroke in a period, a stroke according to the maximum value of a current in a period, a stroke according to the minimum value of a current in a period, or a stroke calculated by subtracting a stroke according to the minimum value of a current in a period from a stroke according to the maximum value of a current in a period.

6. The apparatus of claim 1, wherein the apparatus further comprises a first comparator comparing the operating frequency command value and the present operating frequency and outputting a comparison value of the operating frequency.

7. The apparatus of claim 6, wherein the apparatus further comprises:

a current detecting unit detecting a current applied to a compressor;

a stroke detecting unit detecting a stroke of the compressor; and a second comparator comparing a stroke output from the stroke detecting unit and a stroke command value and outputting a comparison value of the stroke.

8. The apparatus of claim 7, wherein the controller controls a stroke by varying the operating frequency of the compressor according to the comparison value of the operating frequency output from the first comparator and varying the voltage applied to the compressor according to the comparison value of the stroke output from the second comparator.

9. The apparatus of claim 6, wherein the apparatus further comprises:

a current detecting unit detecting a current applied to a compressor;

a stroke detecting unit detecting a stroke of the compressor;

a TDC detecting unit detecting a TDC (Top Dead Center) of the compressor;

a second comparator comparing a TDC output from the TDC detecting unit and a TDC command value, and outputting a TDC comparison value.

10. The apparatus of claim 9, wherein the TDC is a position at which an upper limit of the movement of a piston inside a cylinder of the compressor or the volume of the cylinder is the minimum.

11. The apparatus of claim 9, wherein the controller varies the operating frequency of the compressor according to the comparison value of the operating frequency output from the first comparator and applies a voltage to the compressor according to TDC comparison value output from the second comparator.

12. The apparatus of claim 9, wherein the compressor is a reciprocating compressor employing a linear type.

13. The apparatus of claim 1, wherein the mechanical resonance frequency calculating unit calculates a current according to the maximum value of a stroke in a period when a load variation occurs and a current according to the minimum value of a stroke in a period when a load variation occurs as the mechanical resonance frequency.

14. The apparatus of claim 1, wherein the mechanical resonance frequency calculating unit calculates a current value calculated by subtracting a current according to the minimum value of a stroke in a period from a current according to the maximum value of a stroke in a period when a load variation occurs as the mechanical resonance frequency.

15. The apparatus of claim 1, wherein the mechanical resonance frequency calculating unit calculates a stroke according to the maximum value of a current in a period when a load variation occurs and a stroke according to the minimum value of a current in a period when a load variation occurs as the mechanical resonance frequency.

16. The apparatus of claim 1, wherein the mechanical resonance frequency calculating unit calculates a stroke calculated by subtracting a stroke according to the minimum value of a current in a period from a stroke according to the maximum value of a current in a period when a load variation occurs as the mechanical resonance frequency.

17. A method for controlling operation of a reciprocating compressor, comprising the steps of:

detecting a current and a stroke applied to a compressor;

calculating a mechanical resonance frequency based on the detected current and stroke;

determining an operating frequency command value by adding or subtracting the present operating frequency so as to be within a predetermined range of the calculated mechanical resonance frequency; and driving the compressor based on the operating frequency command value.

18. The method of claim 17, wherein the method further comprises the step of:

performing a stroke feedback control by comparing a stroke command value and a stroke detected from the compressor and varying the voltage applied to the compressor according to the comparison result.

19. The method of claim 17, wherein the method further comprises the step of:

performing a TDC feedback control of a piston by comparing a TDC command value and the present TDC detected from the compressor and varying the voltage applied to the compressor according to the comparison result.

20. The method of claim 17, wherein the mechanical resonance frequency is one of a current according to the maximum value of a stroke in a period when a load variation occurs, a current according to the minimum value of a stroke in a period when a load variation occurs, a current value calculated by subtracting a current according to the minimum value of a stroke in a period from a current according to the maximum value of a stroke in a period when a load variation occurs, a stroke according to the maximum value of a current in a period when a load variation occurs, a stroke according to the minimum value of a current in a period when a load variation occurs, or a stroke calculated by subtracting a stroke according to the minimum value of a current in a period from a stroke according to the maximum value of a current in a period when a load variation occurs.

21. The method of claim 17, wherein the step of driving the compressor by the operating frequency command value comprises the steps of:

determining the present operating frequency as an operating frequency command value without a frequency variation when the present operating frequency is a value within a predetermined range of the mechanical resonance frequency;

increasing the present operating frequency to a predetermined level when the present operating frequency is larger than the predetermined range of the mechanical resonance frequency and determining the increased operating frequency as an operating frequency command value; and decreasing the present operating frequency to a predetermined level when the present operating frequency is smaller than the predetermined range of the mechanical resonance frequency and determining the decreased operating frequency as an operating frequency command value.

22. The method of claim 21, wherein the predetermined range of the mechanical resonance frequency is set in proportion to one of a current according to the maximum value of a stroke in a period, a current according to the minimum value of a stroke in a period, or a current calculated by subtracting a current according to the minimum value of a stroke in a period from a current according to the maximum value of a stroke in a period.

23. The method of claim 21, wherein the predetermined range of the mechanical resonance frequency is set in proportion to one of a stroke according to the maximum value of a current in a period, a stroke according to the minimum value of a current in a period, or a stroke calculated by subtracting a stroke according to the minimum value of a current in a period from a stroke according to the maximum value of a current in a period.

* * * * *